US005625902A

United States Patent [19]

Drews et al.

[11] Patent Number: 5,625,902

[45] Date of Patent: May 6, 1997

[54] PROTECTIVE HOOD MADE OF AN ELASTIC MATERIAL

[75] Inventors: Ralf Drews; Hartmut Kintzel, both of Lübeck, Germany

[73] Assignee: Drägerwerk AG, Lübeck, Germany

[21] Appl. No.: 546,811

[22] Filed: Oct. 23, 1995

[30] Foreign Application Priority Data

Dec. 2, 1994 [DE] Germany ..... 44 42 926.6
Mar. 18, 1995 [DE] Germany ..... 195 09 983.4

[51] Int. Cl.[6] ..... A62B 7/00; A62B 18/04

[52] U.S. Cl. ..... 2/205; 128/201.23

[58] Field of Search ..... 2/202, 205, 206, 2/7, 171; 128/201.22, 201.23, 201.29

[56] References Cited

U.S. PATENT DOCUMENTS 2,435,167 1/1948 Stetson ..... 128/201.23
3,458,864 8/1969 Austin et al. ..... 128/201.23 X
3,521,629 7/1970 Reynolds ..... 128/201.23
4,610,247 9/1986 Stroup ..... 128/201.22 X
4,870,959 10/1989 Reisman et al. ..... 128/201.22 X

FOREIGN PATENT DOCUMENTS

2721727C2 11/1988 Germany .

*Primary Examiner*—Peter Nerbun
*Attorney, Agent, or Firm*—McGlew and Tuttle

[57] ABSTRACT

A protective hood (1) made of an elastic, elastomeric, gas-impermeable material, with a head area (2) and a neck area (4) joining the head area (2) with its top end (3), is to be improved such that good seating of the protective hood is achieved at different head sizes. This object is accomplished by the protective hood (1) being made in one piece according to the dipping process by means of a plate-shaped mold, the material of the protective hood having an elongation at tear greater than or equaling 600% and a modulus 100% of 0.15 to 1.3 N/mm$^3$, and that with the protective hood (1) folded up flat, the greatest width (10) of the head area (2) is 250 mm to 340 mm and preferably about 287 mm.

21 Claims, 1 Drawing Sheet

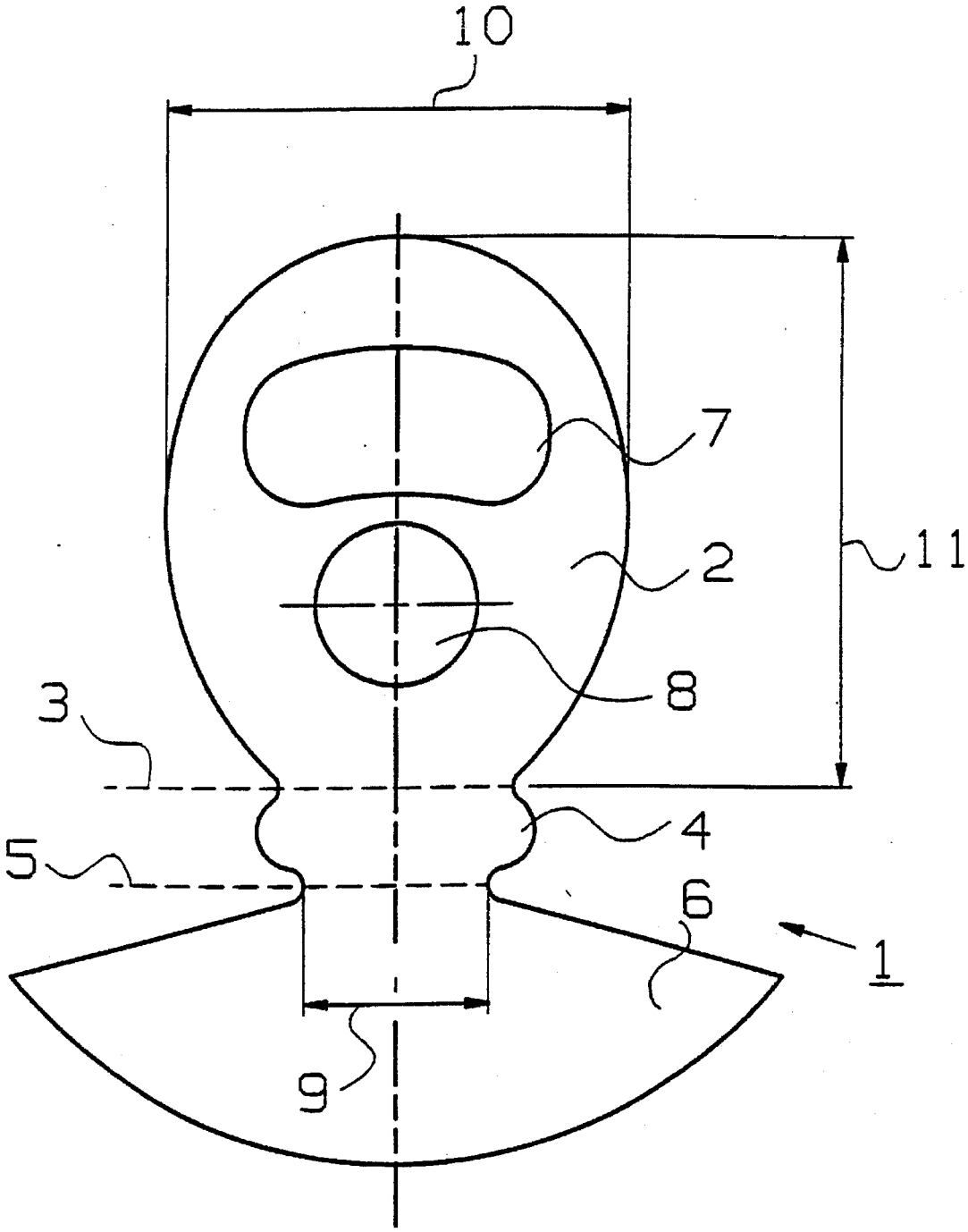
10
7
2
11
8
3
4
5
6
1
9

PROTECTIVE HOOD MADE OF AN ELASTIC MATERIAL

REFERENCE TO U.S. GOVERNMENT INTEREST

This invention was made with Government support under F 33657-92-C-2120 awarded by the Department of U.S. Air Force. The Government has certain rights to this invention.

FIELD OF THE INVENTION

The present invention pertains to a protective hood made of an elastic, elastomeric, gas-impermeable material, with a head area and with a neck area joining the head area with its top end.

BACKGROUND OF THE INVENTION

A protective hood made of an elastic material has become known from DE 27 21 727 C2. The prior-art protective hood is used for protection against undesired substances in an outside atmosphere, and it has an oxygen-breathing apparatus, through which a user of the hood can breathe air or oxygen in a suitable manner. The hood consists of an elastomeric material, which is in tight contact with the head of the user of the hood and is provided for different sizes of heads. When a uniform hood size is used for different head sizes, compromises must inevitably be made in the case of the prior-art protective hood. Good fitting shape is achieved, in general, for an average head size. If the same hood is placed on a larger head, it is generally seated too tightly. Since the hood is also stretched more extensively when placed on the larger head, the material of the hood can undergo plastic deformation, and the hood will no longer be in uniform contact with the face of the user of the hood. If, in contrast, the hood is used by a person with a smaller head, it will frequently fit loosely. If the hood has undergone plastic deformation when put on, or it is generally seated loosely on the head of the user of the hood, an oxygen-breathing apparatus located in the hood usually must also be secured with additional straps. This reduces the wear comfort. In addition, the head area and the neck area are designed as separate components in the prior-art hood, and they are connected to one another at a seam area. Such connection areas are especially prone to tearing; thus, a tear may develop in the hood at the connection area when put on.

SUMMARY AND OBJECTS OF THE INVENTION

The primary object of the present invention is to improve a protective hood of the above-described type in terms of the wear properties and to dimension it such that an oxygen-breathing apparatus can be held by the hood material alone, without any additional straps. In addition, the hood shall be able to be manufactured in a simple manner and at low cost.

This object is accomplished by the protective hood being made in one piece according to a dipping process by means of an essentially plate-shaped mold, the material of the protective hood having an elongation at tear greater than or equaling 600% and a modulus 100% of 0.15N/mm$^2$ to 1.3N/mm$^2$, and by the greatest width of the head area being 250 mm to 340 mm and preferably about 287 mm with the protective hood folded up flat.

The advantage of the present invention is essentially the fact that due to the indicated dimensioning of the hood for the head area and to the selection of the hood material with an elongation at tear greater than 600% and an elastic modulus 100% in the range of 0.15N/mm$^2$ to 1.3N/mm$^2$, good stretchability of the hood when putting on in the elastic range of deformation and good seating are achieved, so that an oxygen-breathing apparatus can be held in the correct position by the hood material alone without additional straps. The range indicated according to the present invention for the elastic modulus which is 100% within the range can be set by selecting the plasticizing agent in the material of the hood. The manufacture of the hood in one piece according to the dipping process can be carried out at a particularly low cost.

The protective hood is manufactured according to the present invention by means of a plate-like mold, which is dipped into the elastomer solution several times until the desired material thickness is reached. The contour of the plate-shaped mold corresponds to that of the protective hood folded up flat.

The smallest width of the neck area of the protective hood is advantageously in a range of 85 mm to 180 mm. The preferred width is about 120 mm. On the one hand, good sealing is achieved with the width indicated according to the present invention for the neck area, and, on the other hand, the protective hood can still come properly into contact.

The height of the head area, measured from the top end of the neck area, is advantageously 250 mm to 420 mm, and preferably about 330 mm.

A collar-like shoulder part is advantageously made in one piece with the lower end of the neck area, i.e., the shoulder part is made directly in one piece with the neck area.

Particularly good seating of the protective hood is achieved if the head area has an oval design.

A suitable thickness of the material of the protective hood is between 0.15 mm and 0.5 mm. A material thickness of 0.3 mm is preferred.

The material of the protective hood advantageously consists of butyl rubber with a plasticizer content greater than or equaling 3%. A butyl rubber elastomer with a plasticizer content between 3% and 17% is preferred.

The plasticizer is advantageously a paraffin-based plasticizer.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The only figure is a front view of a protective hood, folded (or lying) flat.

DETAILED DESCRIPTION OF THE PREFERRED EMBODIMENT

The only figure shows a protective hood 1, folded up flat, which has a head area 2, a neck area 4, which joins the head area 2 with its top end 3 in one piece, and a flaccid, collar-like shoulder part 6, which originates from a lower end 5 of the neck area 4. Within the head area 2, the protective hood 1 has a first opening 7 for an eye-protecting lens, not shown in the figure, and a second opening 8 for an oxygen-breathing apparatus, likewise not shown in the figure. The oxygen-breathing apparatus may be welded to the hood material or be connected to the hood material by means of a clip.

With the protective hood 1 folded up flat, the smallest width 9 of the neck area 4 is about 120 mm, the greatest width 10 of the head area 2 is about 287 mm, and the height 11 of the head area 2, measured from the top end 3 of the neck area 4, is about 330 mm.

The protective hood 1 is made of an elastomeric material, which has an elongation at tear greater than or equaling 600% and an elastic modulus 100% within the range of 0.15 to 1.3N/ram$^2$. Such material properties can be set by selecting the percentage of the plasticizer in the elastomer mixture. The percentage of the plasticizer is between 3% and 17%, and the plasticizer is paraffin-based. The thickness of the hood material of the protective hood 1 is 0.3 mm.

The protective hood 1 is manufactured by a plate-shaped mold, which is not shown in the figure and has the hood contour illustrated in the figure, being dipped several times into a container containing liquid elastomer, until the desired material thickness is reached. After vulcanization of the hood material, the protective hood is pulled off from the mold, and the eye-protecting lens, which is not shown in the figure, and the oxygen-breathing apparatus, likewise not shown, can then be mounted.

The protective hood 1 according to the present invention has a good fitting shape for different head sizes, it has comfortable wear properties because of its good stretchability, and it can be put on in a simple manner.

While a specific embodiment of the invention has been shown and described in detail to illustrate the application of the principles of the invention, it will be understood that the invention may be embodied otherwise without departing from such principles.

What is claimed is:

1. A protective hood, comprising an elastic, elastomeric, gas-impermeable material defining a head area and a neck area, the neck area joining the head area at a top end of the neck area, the protective hood being formed in one piece by dipping an essentially plate-shaped mold in said material, said material having an elongation at tear greater than or equaling 600% and having a modulus of elasticity 100% within a range of 0.15N/mm$^2$ to 1.3N/mm$^2$, said hood being foldable into a flat state, said hood in said flat state having a greatest width of said head area between 250 mm to 340 mm.

2. A protective hood according to claim 1, wherein said greatest width of said head area is about 287 mm.

3. A protective hood according to claim 1, wherein a smallest width of said neck area with said protective hood in said flat state is 85 mm to 180 mm.

4. A protective hood according to claim 3, wherein said smallest width of said neck area of said protective hood in said folded state is about 120 mm.

5. A protective hood according to claim 1, wherein said head area has a height, with said protective hood in said folded state which is between 250 mm and 420 mm.

6. A protective hood according to claim 5, wherein said height of said head area with said protective hood in said folded state is about 330 mm.

7. A protective hood according to claim 1, further comprising a collar-like shoulder part connected in one piece to a lower end of said neck area.

8. A protective hood according to claim 1, wherein said head area has an oval shape.

9. A protective hood according to claim 1, wherein a thickness of said material of said protective hood is from 0.15 mm to 0.5 mm.

10. A protective hood according to claim 9, wherein said thickness of said material of said protective hood is about 0.3 mm.

11. A protective hood according to claim 1, wherein said elastomeric material is butyl rubber with a plasticizer content greater than or equaling 3%.

12. A protective hood according to claim 11, wherein said plasticizer is a paraffin-based plasticizer.

13. A protective hood,comprising:

an elastic,elastomeric, gas-impermeable material defining a one piece protective element formed by dipping an essentially plate-shaped mold in said material, said one piece protective element including a head area and a neck area, said one piece protective element continuing from said neck area into said head area at a top end of the neck area, said material having an elongation at tear greater than or equaling 600% and having a modulus of elasticity 100% within a range of 0.15N/mm$^2$ to 1.3N/mm$^2$, said hood being foldable into a flat state, said hood in said flat state having a greatest width of said head area between 250 mm to 340 mm.

14. A protective hood according to claim 13, wherein said greatest width of said head area is about 287 mm and a smallest width of said neck area with said protective hood in said flat state is about 120 mm and said head area has a height, with said protective hood in said folded state, of about 330 mm.

15. A protective hood according to claim 13, further comprising a collar-like shoulder part connected to said neck area to form said one piece.

16. A protective hood according to claim 13, wherein said head area has an oval shape.

17. A protective hood according to claim 13, wherein a thickness of said material of said protective hood is from 0.15 mm to 0.5 mm.

18. A protective hood according to claim 13, wherein said elastomeric material is butyl rubber with a plasticizer content greater than or equaling 3%.

19. A protective hood according to claim 18, wherein said plasticizer is a paraffin-based plasticizer.

20. A protective hood, comprising:

an elastic, elastomeric, gas-impermeable material formed as a seamless integral one piece protective element by dipping an essentially plate-shaped mold in said material, said one piece protective element including a head area and a neck area, said one piece protective element continuing uninterrupted from said neck area into said head area at a top end of the neck area, said material having an elongation at tear greater than or equaling 600% and having a modulus of elasticity 100% within a range of 0.15N/mm$^2$ to 1.3N/mm$^2$ with an opening to define breathing apparatus support means for holding a breathing apparatus with said hood material alone, the breathing apparatus extending out of said opening, said hood being foldable into a flat state, said hood in said flat state having a greatest width of said head area between 250 mm to 340 mm.

21. A protective hood, comprising:

an elastic, elastomeric, gas-impermeable material comprising butyl rubber with a plasticizer content greater than or equaling 3% formed as a seamless integral one piece protective element by dipping an essentially plate-shaped mold in said material, said one piece protective element including a head area and a neck area, said one piece protective element continuing uninterrupted from said neck area into said head area at a top end of the neck area, said material having an elongation at tear greater than or equaling 600% and having a modulus of elasticity 100% within a range of 0.15N/mm$^2$ to 1.3N/mm$^2$ with an opening to define breathing apparatus support means for holding a breathing apparatus with said hood material alone, the breathing apparatus extending out of said opening, said hood being foldable into a flat state, said hood in said flat state having a greatest width of said head area between 250 mm to 340 mm.

* * * * *